United States Patent [19]

Hance et al.

[11] Patent Number: 4,532,852

[45] Date of Patent: Aug. 6, 1985

[54] RAPID FIRE ATTACHMENT FOR SEMI-AUTOMATIC FIREARMS

[76] Inventors: Richard O. Hance, 236 Evergreen Rd.; Gerald M. Hansen, Rte. 2, Box 428, both of North Fort Myers, Fla. 33903

[21] Appl. No.: 516,556

[22] Filed: Jul. 25, 1983

[51] Int. Cl.[3] ..... F41C 19/00

[52] U.S. Cl. ..... 89/136

[58] Field of Search ..... 89/27.3, 27 F, 129 B, 89/132, 136, 140

[56] References Cited

U.S. PATENT DOCUMENTS 4,246,829 1/1981 Koehler ..... 89/27.3

4,276,808 7/1981 York ..... 89/136

*Primary Examiner*—Stephen C. Bentley

*Attorney, Agent, or Firm*—Hauke and Patalidis

[57] ABSTRACT

An attachment or accessory, for semi-automatic firearm, comprising a housing releasably attached to the trigger guard of the firearm, a rotor member rotatably supported in the housing and having cams or lobes adapted to repeatedly actuate the firearm trigger through the intermediary of a rocker member actuated by the rotor cams when the rotor member is rotated. A lever-supported crank and a meshing pinion arrangement rotates the rotor through a one-way clutch coupling when the lever is displaced in one direction, the one-way clutch coupling disconnecting the rotor from the pinion when the lever is displaced in an opposite direction to a return position.

30 Claims, 3 Drawing Figures

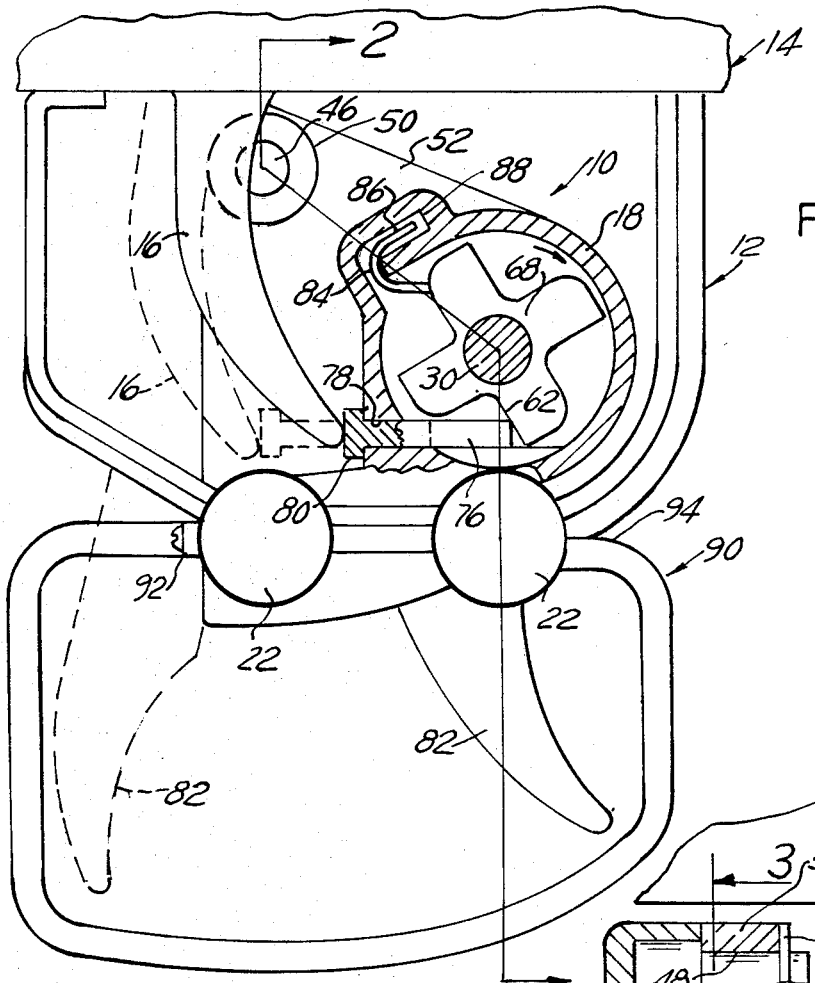
FIG. 1
FIG. 2
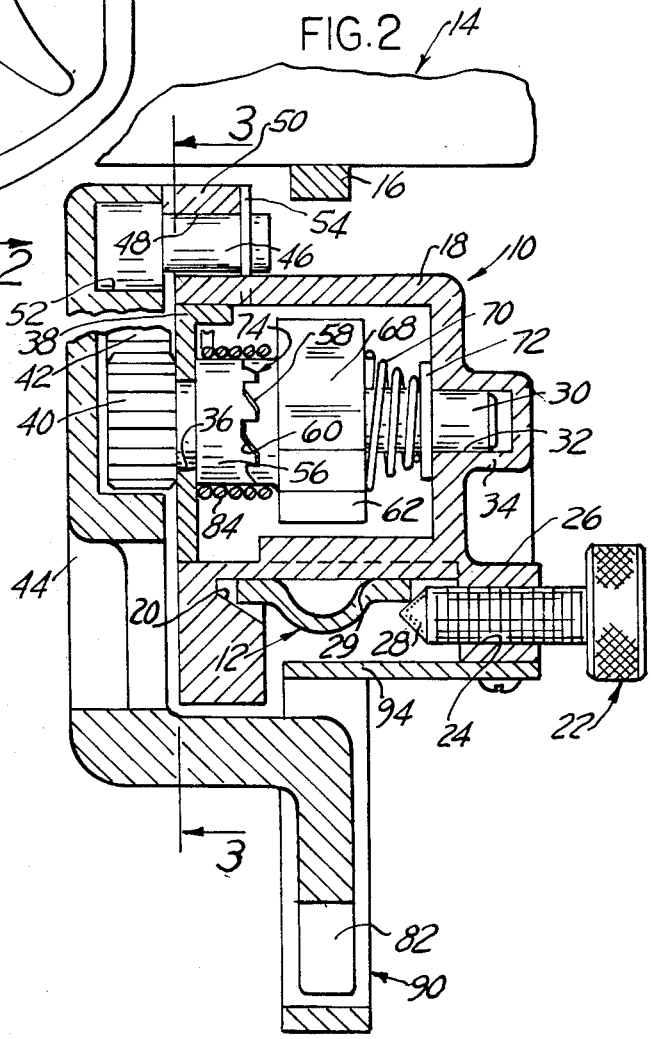
FIG. 3
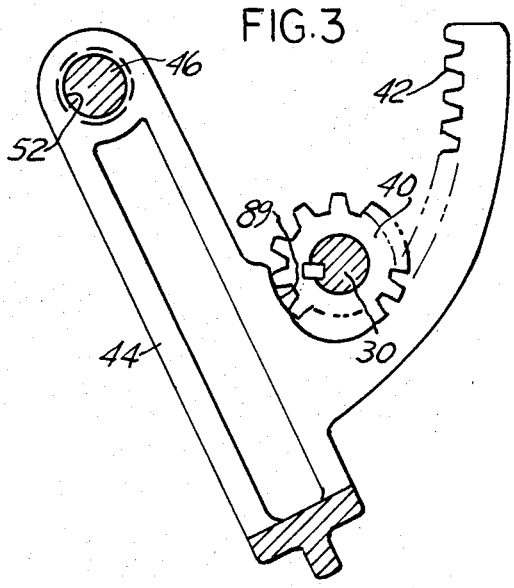

RAPID FIRE ATTACHMENT FOR SEMI-AUTOMATIC FIREARMS

BACKGROUND OF THE INVENTION

The present invention relates to an accessory or attachment for semi-automatic firearms, and more particularly to an accessory removably attached to the trigger guard of a conventional semi-automatic firearm allowing the user to achieve burst firing of the firearm.

Semi-automatic firearms presently available on the market do not permit burst firing of several rounds of ammunition through a single pull of the trigger. Only military weapons are provided with control means, generally associated with a safety, which permit, at will, either single shot firing of the weapon or burst firing according to the selected firing mode.

Private ownership of automatic firearms generally violates the firearm registration laws of the United States. Conversion of semi-automatic firearms into automatic firearms through reconstruction or modification of the trigger and sear mechanism, and possession of such converted firearms is also prohibited under the United States registration laws for firearms. However, it is permissible to convert a conventional semi-automatic firearm to one capable of firing a short burst of rounds through repeated actuation of the trigger, thus duplicating the normal action of a finger during normal rapid firing of the weapon.

In U.S. Pat. No. 4,276,808, there is disclosed a burst firing attachment consisting of a device removably attached to the firearm trigger guard. The device comprises a crank rotating a rotor operating a striker rod. The striker rod projects against the firearm trigger and is reciprocated by lobes or cams on the rotor, when the crank is rotated.

While such a device accomplishes the purpose of permitting burst firing of a firearm, rotation of the crank with one hand while attempting to hold and stabilize the firearm with another hand is "unnatural" and awkward, is disruptive of careful aiming, and may somewhat be considered as being dangerous as the crank may be accidentally rotated, or may become caught in clothing or in bushes.

SUMMARY OF THE INVENTION

The present invention provides a simple and low-cost burst firing attachment or accessory for conventional semi-automatic firearms, such as a semi-automatic rifle, removably attached to the trigger guard of the firearm, and comprising an actuating member in the form of a trigger-like lever allowing burst firing of a few rounds of ammunition as a result of a single stroke of the trigger-like lever.

The many objects and advantages of the present invention will become apparent to those skilled in the art when the following description of the best mode contemplated at the present for practicing the invention is read in conjunction with the accompanying drawing wherein:

BRIEF DESCRIPTION OF THE DRAWING

FIG. 1 is a side elevation view of an example of structure according to the present invention, shown attached to a firearm trigger guard and with portions broken away to show the internal construction;

FIG. 2 is a transverse section substantially along line 2—2 of FIG. 1; and FIG. 3 is a section substantially along line 3—3 of FIG. 2.

DETAILED DESCRIPTION OF THE PREFERRED EMBODIMENT

Referring to the drawing and more particularly to FIG. 1, a rapid fire accessory or apparatus 10 according to the invention is illustrated removably attached within the trigger guard 12 of a semi-automatic firearm, such as for example a 22-caliber semi-automatic rifle, a portion of the stock 14 of the rifle being only shown in the drawing. A trigger guard 12 surrounds the firearm trigger 16 which projects from below the stock 14 and which, as is well known, it normally pulled by a finger for firing the rifle. The trigger 16, which pivots around a pivot point within the stock 14, is normally urged toward its forward position by appropriate spring means, not shown, such forward non-firing position being illustrated at FIG. 1.

The burst firing apparatus 10 of the invention comprises a housing 18, which may be made of rigid high impact plastic or of metal, preferably light metal such as aluminum. The housing 18 is clamped to the trigger guard 12, as shown, for example by being provided on one side with a groove 20, FIG. 2, engageable over an edge of the bottom portion of the trigger guard 12, and by being provided, on the other side, with a clamping thumbscrew 22, or preferably a pair of clamping thumbscrews 22, each threadably disposed transversely through a threaded bore 24 in a boss 26 integrally formed in the housing 18 and having a tapered tip 28 projecting below the opposite edge of the bottom portion of the trigger guard 12 when the thumbscrews 22 are tightened, thus drawing the lower surface 29 of the housing 18 in firm engagement with the bottom interior surface of the trigger guard 12.

A shaft 30 is transversely disposed in the housing 18, and has an end journalled in an appropriate bore 32 formed in a boss 34 on one side of the housing 18. The shaft 30 is supported at its other end in a bore 36 formed in a cover plate 38 closing the other open, side of the housing 18. The shaft 30 has an end projecting beyond the cover plate 38 around which is mounted a pinion 40. The pinion 40 is appropriately attached to the projecting end of the shaft 30 such that rotation of the pinion 40 causes rotation of the shaft 30. The pinion 40, FIGS. 2 and 3, is capable of being driven in rotation by a sector rack 42 mounted on, or made integral with, a pivotable lever 44. The pivotable lever 44 is provided at its upper end with a pin 46 projecting laterally through a bore 48 disposed in a boss 50 formed at the upper end of an integral flange extension 52, FIG. 1, of the housing 18. The pin 46 is, for example, press-fitted in an appropriate bore 52, FIG. 2, formed in the end of the lever 44, and is prevented from being pulled from the bore 48 by any conventional retaining means such as a spring snap ring retainer 54, FIG. 2, engaged in a groove, not shown, in the projecting portion of the pin 46.

A ratchet wheel 56, FIG. 2, is fixedly mounted on the shaft 30 on the other side of the cover plate 38 and has a side face provided with inclined teeth 58 normally engaged with similarly disposed inclined teeth 60 formed on a side face of a lobed rotor 62 mounted freely rotatable on the shaft 30. A compressed coil spring 70, disposed around the shaft 30 between the other side of the lobed rotor 68 and a shoulder abutment on the shaft 30, in the form of a snap spring ring 72 disposed in an appropriate groove, not shown, in the periphery of the shaft 30, constantly urges the lobed rotor 68 with its teeth 60 on its side in engagement with the teeth 58 of the ratchet wheel 56. As a result of the inclined ratchet wheel lateral teeth 58 co-operating with the inclined rotor lateral teeth 60, there is formed a one-way clutch arrangement, generally designated at 74 which, when the pinion 40 is rotated, thus rotating the shaft 30 and in turn rotating the ratchet wheel 56, causes rotation of the lobed rotor 62 in one direction only, the direction of rotation of the lobed rotor 62 being clockwise, as illustrated at FIG. 1. A striker member 76 which, preferably, is in the form of a rectangular plate, is slidably disposed through an aperture 78 in the side of the housing 18 proximate to the rifle trigger 16 such that the end 80 of the striker member 76 is engaged with or disposed proximate the end portion of the trigger 16.

The lever 44 is provided with a trigger-like extension 82, or secondary trigger, which, upon pulling by a finger, pivots the lever 44 and therefore drives the pinion 40 through the arcuate rack 42. Rotation of the ratchet wheel 56, coupled to the pinion 40 through the shaft 30 causes the lobed rotor 62 to be rotated clockwise, thus in turn reciprocating the striker member 76, with the result that the rifle trigger 16 is sequentially reciprocated, and a burst of ammunition rounds is fired. The rifle trigger 16 is returned to the position shown in full line at FIG. 1 by the spring bias associated with the trigger, and after the secondary trigger 82 has been displaced from the position shown in full line at FIG. 1 to the position shown in phantom line during burst firing, it is returned to its original position by means of a return helical spring 84 having a bent up portion 86 engaged in a slot 88 in the housing 18 and another end attached, for example, to an abutment tang, not shown, on the ratchet wheel 56. During return of the secondary trigger 82 under the action of the return spring 84, reverse rotation of the ratchet wheel 56 causes reverse rotation of the pinion 40, thus driving the arcuate rack 42 and the lever 44 to their return position. The lever 44 has a lateral abutment surface 89, FIG. 3, engageable with the top of the teeth of the pinion 40 in the return position of the secondary trigger 82 formed at the end of the lever 44. The direction of inclination of the lateral teeth 58 and 60 of, respectively, the ratchet wheel 56 and the lobed rotor 62, allow reverse rotation of the ratchet wheel 56, shaft 30 and pinion 40 while, even if the lober rotor 62 were frictionally urged in a counter-clockwise rotation by the rotation of the shaft 30, one of the lobes 68 abutting against the upper surface of the striker member 76 prevents counter-clockwise rotation of the lobed rotor 62.

If so desired, a secondary trigger guard 90, FIGS. 1 and 2, is mounted around the secondary trigger 82, for the purpose of safety. The secondary trigger guard 90 may be removably attached to the primary trigger guard 12 or, in the alternative and as shown, it may have an end 92 attached to the bottom of the housing 18, as shown at FIG. 1 and another end 94 in the form of a bracket attached below the housing 18 at the boss 26, FIG. 2.

It will be appreciated by those skilled in the art that the present invention can take forms other than the example of structure specifically illustrated and described hereinbefore. For example, the one-way clutch arrangement 74 can take the form of any one of a variety of well known one-way clutch drive mechanisms, incorporated in the lobed rotor 62 or, alternatively, in the pinion 40, such one-way clutch drive mechanism being, for example, of the pawl and ratchet type, or of the wedging ball or roller type. It will also be appreciated that the lobed rotor 62 may be provided with a smaller or greater number of lobes 68, and with different lobe shapes, without departing from the spirit and scope of the present invention.

Having thus described the present invention by way of an example of structure well designed to accomplish the objects of the invention, modifications whereof will be apparent to those skilled in the art, what is claimed as new is as follows:

1. An apparatus for burst firing of a semi-automatic firearm, said firearm having a trigger enclosed within a trigger guard and said apparatus comprising a housing, clamp means for releasably attaching said housing within said trigger guard, rotor means rotatably supported in said housing, reciprocable striker means projecting at one end from said housing and being operable by said rotor means for actuating said firearm trigger upon rotation of said rotor means, lever means pivotably attached to said housing, said lever means having an end in the form of a trigger, and means coupling said lever means to said rotor means for driving said rotor means in rotation, and a secondary trigger guard disposed around said lever.

2. The apparatus of claim 1 wherein said rotor means has a plurality of lobes arranged to sequentially engage an end of said striker means disposed upon rotation of said rotor means.

3. The apparatus of claim 1 wherein said means coupling said lever means to said rotor means comprises a rack member attached to said lever means, a pinion coaxial with said rotor means, said pinion being in mesh with said rack member, and one-way coupling means between said pinion and said rotor means.

4. The apparatus of claim 2 wherein said means coupling said lever means to said rotor means comprises a rack member attached to said lever means, a pinion coaxial with said rotor means, said pinion being in mesh with said rack member, and one-way coupling means between said pinion and said rotor means.

5. The apparatus of claim 1 further comprising spring return means for said lever means.

6. The apparatus of claim 2 further comprising spring return means for said lever means.

7. The apparatus of claim 3 further comprising spring return means for said lever means.

8. The apparatus of claim 4 further comprising spring return means for said lever means.

9. The apparatus of claim 1 wherein said clamp means comprises a groove in said housing for engaging an edge of said trigger guard, and a clamping screw on said housing having a tapered end selectively engageable below an opposite edge of said trigger guard for clamping said housing against said trigger guard.

10. The apparatus of claim 2 wherein said clamp means comprises a groove in said housing for engaging an edge of said trigger guard, and a clamping screw on said housing having a tapered end selectively engageable below an opposite edge of said trigger guard for clamping said housing against said trigger guard.

11. The apparatus of claim 3 wherein said clamp means comprises a groove in said housing for engaging an edge of said trigger guard, and a clamping screw on said housing having a tapered end selectively engageable below an opposite edge of said trigger guard for clamping said housing against said trigger guard.

12. The apparatus of claim 4 wherein said clamp means comprises a groove in said housing for engaging an edge of said trigger guard, and a clamping screw on said housing having a tapered end selectively engageable below an opposite edge of said trigger guard for clamping said housing against said trigger guard.

13. The apparatus of claim 5 wherein said clamp means comprises a groove in said housing for engaging an edge of said trigger guard, and a clamping screw on said housing having a tapered end selectively engageable below an opposite edge of said trigger guard for clamping said housing against said trigger guard.

14. The apparatus of claim 6 wherein said clamp means comprises a groove in said housing for engaging an edge of said trigger guard, and a clamping screw on said housing having a tapered end selectively engageable below an opposite edge of said trigger guard for clamping said housing against said trigger guard.

15. The apparatus of claim 7 wherein said clamp means comprises a groove in said housing for engaging an edge of said trigger guard, and a clamping screw on said housing having a tapered end selectively engageable below an opposite edge of said trigger guard for clamping said housing against said trigger guard.

16. The apparatus of claim 8 wherein said clamp means comprises a groove in said housing for engaging an edge of said trigger guard, and a clamping screw on said housing having a tapered end selectively engageable below an opposite edge of said trigger guard for clamping said housing against said trigger guard.

17. An apparatus for burst firing of a semi-automatic firearm, said firearm having a trigger enclosed within a trigger guard and said apparatus comprising a housing, clamp means for releasably attaching said housing within said trigger guard, rotor means rotatably supported in said housing, reciprocable striker means projecting at one end from said housing and being operable by said rotor means for actuating said firearm trigger upon rotation of said rotor means, lever means pivotably attached to said housing, said lever means having an end in the form of a trigger, and means coupling said lever means to said rotor means for driving said rotor means in rotation, and spring return means for said lever means.

18. The apparatus of claim 17 wherein said rotor means has a plurality of lobes arranged to sequentially engage an end of said striker means disposed upon rotation of said rotor means.

19. The apparatus of claim 17 wherein said means coupling said lever means to said rotor means comprises a rack member attached to said lever means, a pinion coaxial with said rotor means, said pinion being in mesh with said rack member, and one-way coupling means between said pinion and said rotor means.

20. The apparatus of claim 18 wherein said means coupling said lever means to said rotor means comprises a rack member attached to said lever means, a pinion coaxial with said rotor means, said pinion being in mesh with said rack member, and one-way coupling means between said pinion and said rotor means.

21. The apparatus of claim 17 wherein said clamp means comprises a groove in said housing for engaging an edge of said trigger guard, and a clamping screw on said housing having a tapered end selectively engageable below an opposite edge of said trigger guard for clamping said housing against said trigger guard.

22. The apparatus of claim 18 wherein said clamp means comprises a groove in said housing for engaging an edge of said trigger guard, and a clamping screw on said housing having a tapered end selectively engageable below an opposite edge of said trigger guard for clamping said housing against said trigger guard.

23. The apparatus of claim 19 wherein said clamp means comprises a groove in said housing for engaging an edge of said trigger guard, and a clamping screw on said housing having a tapered end selectively engageable below an opposite edge of said trigger guard for clamping said housing against said trigger guard.

24. The apparatus of claim 20 wherein said clamp means comprises a groove in said housing for engaging an edge of said trigger guard, and a clamping screw on said housing having a tapered end selectively engageable below an opposite edge of said trigger guard for clamping said housing against said trigger guard.

25. An apparatus for burst firing of a semi-automatic firearm, said firearm having a trigger enclosed within a trigger guard and said apparatus comprising a housing, clamp means for releasably attaching said housing within said trigger guard, rotor means rotatably supported in said housing, reciprocable striker means projecting at one end from said housing and being operable by said rotor means for actuating said firearm trigger upon rotation of said rotor means, lever means pivotably attached to said housing, said lever means having an end in the form of a trigger, and means coupling said lever means to said rotor means for driving said rotor means in rotation, wherein said means coupling said lever means to said rotor means comprises a rack member attached to said lever means, a pinion coaxial with said rotor means, said pinion being in mesh with said rack member, and one-way coupling means between said pinion and said rotor means.

26. The apparatus of claim 25 wherein said rotor means has a plurality of lobes arranged to sequentially engage an end of said striker means disposed upon rotation of said rotor means.

27. The apparatus of claim 25 wherein said clamp means comprises a groove in said housing for engaging an edge of said trigger guard, and a clamping screw on said housing having a tapered end selectively engageable below an opposite edge of said trigger guard for clamping said housing against said trigger guard.

28. The apparatus of claim 26 wherein said clamp means comprises a groove in said housing for engaging an edge of said trigger guard, and a clamping screw on said housing having a tapered end selectively engageable below an opposite edge of said trigger guard for clamping said housing against said trigger guard.

29. An apparatus for burst firing of a semi-automatic firearm, said firearm having a trigger enclosed within a trigger guard and said apparatus comprising a housing, clamp means for releasably attaching said housing within said trigger guard, rotor means rotatably supported in said housing, reciprocable striker means projecting at one end from said housing and being operable by said rotor means for actuating said firearm trigger upon rotation of said rotor means, lever means pivotably attached to said housing, said lever means having an end in the form of a trigger, and means coupling said lever means to said rotor means for driving said rotor means in rotation, wherein said clamp means comprises a groove in said housing for engaging an edge of said trigger guard, and a clamping screw on said housing having a tapered end selectively engageable below an opposite edge of said trigger guard for clamping said housing against said trigger guard.

30. The apparatus of claim 29 wherein said rotor means has a plurality of lobes arranged to sequentially engage an end of said striker means disposed upon rotation of said rotor means.

* * * * *